US009902410B2

(12) United States Patent
Palmer et al.

(10) Patent No.: US 9,902,410 B2
(45) Date of Patent: Feb. 27, 2018

(54) SYSTEM AND METHOD FOR SYNTHESIZING RAIL VEHICLE EVENT INFORMATION

(71) Applicant: SmartDrive Systems, Inc., San Diego, CA (US)

(72) Inventors: Jason Palmer, Carlsbad, CA (US); Slaven Sljivar, San Diego, CA (US); Mark Freitas, San Diego, CA (US); Daniel A. Deninger, San Diego, CA (US); Shahriar Ravari, San Diego, CA (US)

(73) Assignee: SmartDrive Systems, Inc., San Diego, CA (US)

( * ) Notice: Subject to any disclaimer, the term of this patent is extended or adjusted under 35 U.S.C. 154(b) by 423 days.

(21) Appl. No.: 14/592,446

(22) Filed: Jan. 8, 2015

(65) Prior Publication Data

US 2016/0200331 A1 Jul. 14, 2016

(51) Int. Cl.
*B61L 15/00* (2006.01)
*B61L 25/02* (2006.01)
(Continued)

(52) U.S. Cl.
CPC ..... *B61L 15/0072* (2013.01); *B61K 9/08* (2013.01); *B61L 25/02* (2013.01); *B61L 27/0077* (2013.01); *B61L 27/0094* (2013.01)

(58) Field of Classification Search
CPC .. B61L 15/0072; B61L 15/0081; B61L 25/02; B61L 27/0083; B61L 27/0088; B61L 27/0094
(Continued)

(56) References Cited

U.S. PATENT DOCUMENTS 5,505,076 A 4/1996 Parkman
5,883,337 A * 3/1999 Dolan ..... G01P 3/66 177/163
(Continued)

FOREIGN PATENT DOCUMENTS

CA 1126093 6/1982
CA 1126093 A 6/1982
(Continued)

OTHER PUBLICATIONS

European Search Report EP16150325.5 dated May 19, 2016 (13 pages).
(Continued)

*Primary Examiner* — Zachary L Kuhfuss
(74) *Attorney, Agent, or Firm* — Sheppard Mullin Richter & Hampton LLP

(57) ABSTRACT

This disclosure relates to a system configured to identify geolocations in a rail network where rail vehicle events are likely to occur. In some implementations, the system may include one or more of a processor, a computing system, electronic storage, external resources, and/or other components. The system may be configured to illustrate the geolocations in the rail network where rail vehicle events are likely to occur on a map of the rail network, predict geolocations in the rail network where rail vehicle events will likely occur, generate coaching information based on the identified geolocations, and/or perform other actions.

20 Claims, 5 Drawing Sheets

(51) Int. Cl.
*B61K 9/08* (2006.01)
*B61L 27/00* (2006.01)

(58) Field of Classification Search
USPC ..... 701/19
See application file for complete search history.

(56) References Cited

U.S. PATENT DOCUMENTS 5,956,664 A * 9/1999 Bryan ..... B61L 23/044 340/870.16
5,995,881 A 11/1999 Kull
6,526,352 B1 2/2003 Breed
6,553,308 B1 4/2003 Uhlmann
7,027,621 B1 4/2006 Prokoski
7,398,140 B2 7/2008 Kernwein
7,698,028 B1 * 4/2010 Bilodeau ..... B61L 23/042 246/120
8,892,310 B1 11/2014 Palmer
9,296,401 B1 3/2016 Palmer
2004/0015276 A1 1/2004 Kane
2005/0107954 A1 5/2005 Nahla
2005/0183627 A1 8/2005 Hommen
2005/0205719 A1 9/2005 Hendrickson
2005/0251337 A1 * 11/2005 Rajaram ..... B61L 23/34 701/301
2006/0098843 A1 5/2006 Chew
2006/0244830 A1 * 11/2006 Davenport ..... B61L 25/021 348/148
2007/0040672 A1 2/2007 Chinigo
2007/0136078 A1 6/2007 Plante
2007/0216771 A1 9/2007 Kumar
2007/0217670 A1 9/2007 Bar-Am
2007/0241874 A1 10/2007 Okpysh
2007/0257804 A1 11/2007 Gunderson
2007/0272116 A1 11/2007 Bartley
2008/0147267 A1 6/2008 Plante
2010/0094489 A1 4/2010 Moffitt
2010/0204857 A1 8/2010 Forrest
2010/0241296 A1 9/2010 Rhea
2010/0327125 A1 12/2010 Braband
2011/0216200 A1 9/2011 Chung
2011/0285842 A1 * 11/2011 Davenport ..... B61L 23/04 348/116
2012/0021386 A1 1/2012 Anderson
2012/0072088 A1 3/2012 Cutright
2012/0130563 A1 5/2012 McBain
2012/0203402 A1 8/2012 Jape
2012/0245908 A1 * 9/2012 Berggren ..... B61K 9/08 703/2
2012/0269383 A1 11/2012 Bobbitt
2013/0018534 A1 1/2013 Hilleary
2013/0032054 A1 2/2013 Schneider
2013/0046421 A1 2/2013 ElFassi
2013/0048795 A1 2/2013 Cross
2014/0012438 A1 1/2014 Shoppa
2014/0047371 A1 2/2014 Palmer
2014/0052315 A1 * 2/2014 Isailovski ..... B61L 3/002 701/19
2014/0257594 A1 9/2014 Hashimoto
2014/0339374 A1 11/2014 Mian
2015/0000415 A1 1/2015 Kelley
2015/0202935 A1 7/2015 Muthusamy
2015/0203116 A1 7/2015 Fairgrieve
2015/0371462 A1 12/2015 Ramesh
2016/0114820 A1 * 4/2016 Palmer ..... B61L 25/02 246/107
2016/0140872 A1 * 5/2016 Palmer ..... G06K 9/00791 434/65
2016/0200330 A1 * 7/2016 Palmer ..... B61L 15/0081 701/29.1
2016/0200333 A1 * 7/2016 Palmer ..... B61L 15/0072 701/19
2016/0292936 A1 * 10/2016 Palmer ..... B60R 16/023

FOREIGN PATENT DOCUMENTS

EP 1115092 A1 7/2001
WO 2005095175 A1 10/2005
WO 2005118366 12/2005
WO 2006125256 11/2006
WO 2006125256 A1 11/2006
WO 2013134615 A1 9/2013

OTHER PUBLICATIONS

Mortlock, "Automatic Train Control: Concept of System," Jun. 28, 2010 Retrieved from http://ww.hsr.ca.gove/docs/programs/eir_memos/Proj_Guidelines_TM3_3_1R00.pdf (64 pages).
PCT International Search Report and Written Opinion for PCT/US2015/066873, dated Feb. 19, 2016 (17 pages).
PCT International Search Report and Written Opinion for PCT/US2016/012757 dated Mar. 18, 2016 (7 pages).

* cited by examiner

SYSTEM AND METHOD FOR SYNTHESIZING RAIL VEHICLE EVENT INFORMATION

FIELD

This disclosure relates to a system configured to identify geolocations in a rail network where rail vehicle events are likely to occur.

BACKGROUND

Typically, trains are not equipped with vehicle event detection systems. Some trains are equipped with cameras but these cameras are usually only used for surveillance purposes to monitor interior passenger compartments. The cameras are not connected to mechanical and/or safety subsystems of the train in any way. The recorded video information from such cameras is typically viewed via a multi-media player configured to play back audio and video. The multi-media players typically include controls for playing, rewinding, fast-forwarding, and pausing the video. These controls are typically used by a human reviewer reviewing the recorded information after the video has been offloaded from the train.

SUMMARY

One aspect of this disclosure relates to a system configured to identify geolocations in a rail network where rail vehicle events are likely to occur. In some implementations, the system may include one or more of a processor, a computing system, electronic storage, external resources, and/or other components. In some implementations, the system may include and/or receive information from one or more rail vehicle event recorders coupled with one or more rail vehicles, one or more rail vehicle event review systems, and/or other sources of information. The rail vehicle event recorders and/or rail vehicle event review systems may include one or more of a sensor, a camera, a transceiver, a processor, electronic storage, a user interface, and/or other components.

The system may be configured to obtain (e.g., from rail vehicle event recorders) information that characterizes rail vehicle parameters during rail vehicle events. The rail vehicle parameters may include geolocations of rail vehicles during the rail vehicle events and/or other parameters. In some implementations, the obtained information that characterizes rail vehicle parameters during rail vehicle events may include times of day of the rail vehicle events, days of the week on which the rail vehicle events occur, and/or other information.

In some implementations, the system may be configured to obtain information (e.g., from rail vehicle event review systems) that characterizes observations associated with the rail vehicle events made by rail vehicle event reviewers and/or other users. In some implementations, the rail vehicle events and/or the observations may be related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, or activation of an ATP bypass high horn, Positive Train Control (PTC), Communications-Based Train Control (CBTC). In some implementations, the information that characterizes the geolocations of rail vehicles during the rail vehicle events may be generated by one or more system location sensors that are coupled with the rail vehicles and/or one or more non-system location sensors that are not coupled with the rail vehicles.

The system may be configured to identify individual combinations of rail vehicle parameters associated with apparently elevated likelihoods of rail vehicle events. The individual identified combinations may include parameters that indicate shared geolocations where rail vehicle events have occurred. In some implementations, this may include normalizing parameters in the identified individual combinations of rail vehicle parameters associated with apparently elevated likelihoods of rail vehicle events based on one or more of a frequency of rail vehicles passing through the shared geolocations where rail vehicle events have occurred, a severity of rail vehicle events at the shared geolocations, and/or other information. In some implementations, the system may be configured to identify individual combinations of observations associated with apparently elevated likelihoods of rail vehicle events. The individual combinations of observations may include observations that indicate shared geolocations where rail vehicle events have occurred, and/or other information. In some implementations, the system may be configured to categorize the shared geolocations where rail vehicle events have occurred based on the time of day, the day of the week, and/or other factors.

The system may be configured to analyze, disseminate, and/or perform other actions with the information related to the shared geolocations where vehicle events have occurred. In some implementations, this may include analyzing, based on the identification of individual combinations of rail vehicle parameters associated with apparently elevated likelihoods of rail vehicle events and/or other information, common features of the shared geolocations and predicting other geolocations in the rail network where rail vehicle events are likely to occur. In some implementations, this may include indicating shared geolocations where rail vehicle events have occurred on a map of the rail network. In some implementations, this may include effectuating communication of instructions to operators of rail vehicles approaching the shared geolocations. In some implementations, this may include generating coaching information based on the shared geolocations where rail vehicle events have occurred for presentation to one or more of a rail vehicle operator or a non-rail vehicle operator user during a coaching session.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
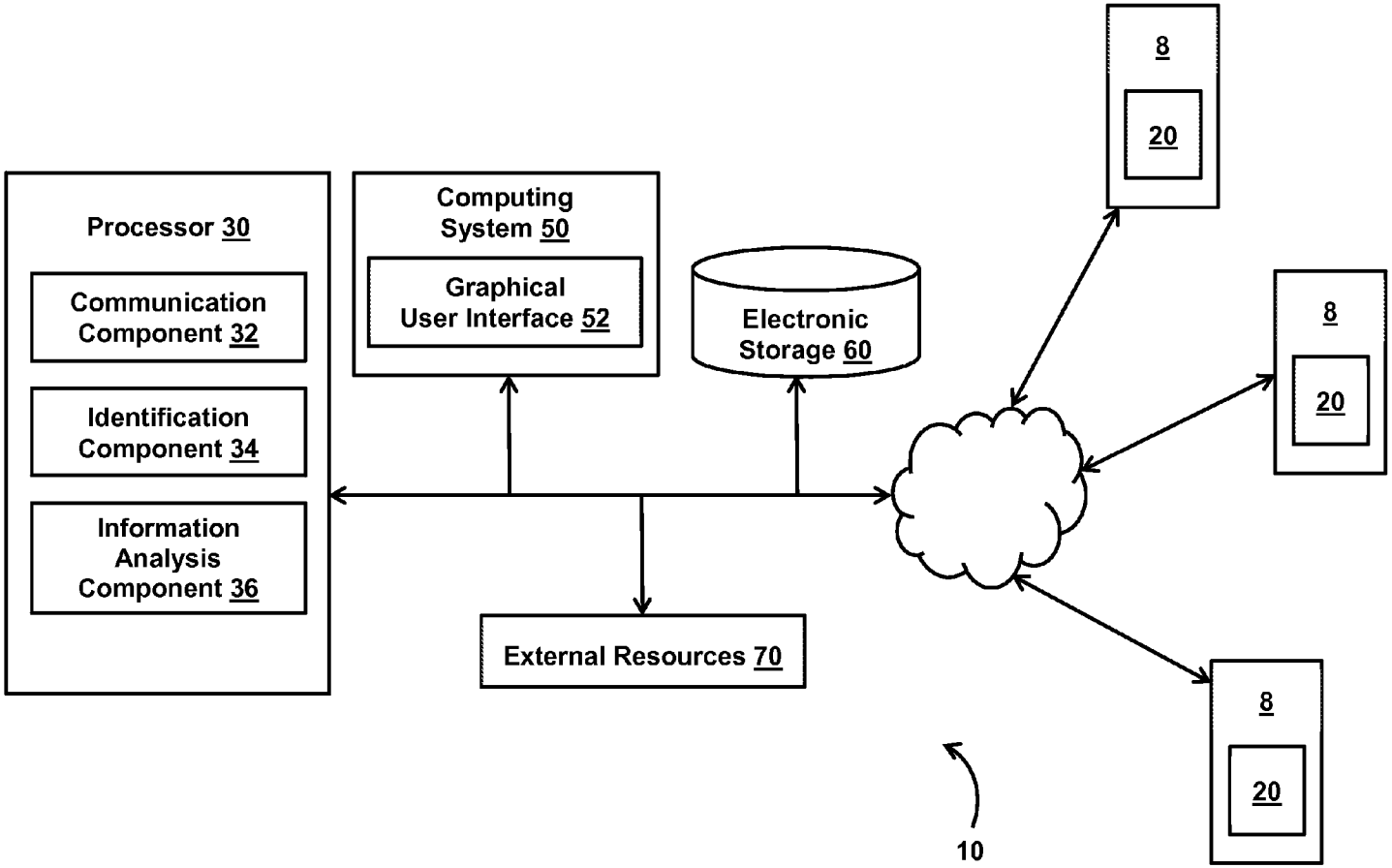
FIG. 1 illustrates system configured to identify geolocations in a rail network where rail vehicle events are likely to occur.

FIG. 1 illustrates a system configured to identify geolocations in a rail network where rail vehicle events are likely to occur. In some implementations, the system may be configured to obtain information that characterizes rail vehicle parameters during rail vehicle events, observations (e.g., made by a reviewer) related to rail vehicle events, and/or other information. The system may be configured to identify individual combinations of rail vehicle parameters and/or observations associated with apparently elevated likelihoods of rail vehicle events. The system may be configured to analyze, disseminate, and/or perform other actions with the information related to the shared geolocations where vehicle events have occurred, and/or other parameters associated with apparently elevated likelihoods of rail vehicle events. In some implementations, this may include analyzing, based on the identification of individual combinations of rail vehicle parameters associated with apparently elevated likelihoods of rail vehicle events and/or other information, common features of the shared geolocations and predicting other geolocations in the rail network where rail vehicle events are likely to occur. In some implementations, this may include indicating shared geolocations where rail vehicle events have occurred on a map of the rail network, effectuating communication of instructions to operators of rail vehicles approaching and/or passing through the shared geolocations, generating coaching information, and/or other analysis and/or dissemination.

In some implementations, system 10 may include one or more of a processor 30, a computing system 50, electronic storage 60, external resources 70, and/or other components. In some implementations, system 10 may include and/or receive information from one or more rail vehicle event recorders 20 coupled with one or more rail vehicles 8. Rail vehicle event recorders 20 may include one or more of a sensor, a camera, a transceiver, a processor, electronic storage, a user interface, and/or other components (illustrated in FIG. 2 and described below). In some implementations, one or more of the components of the rail vehicle event recorder may be the same as and/or similar to one or more components of the rail vehicle event detection system described in U.S. patent application Ser. No. 14/525,416 filed Oct. 28, 2014, and entitled, "Rail Vehicle Event Detection and Recording System", which is incorporated herein by reference in its entirety. In some implementations, system 10 may include and/or receive review information (e.g., observations made by a reviewer and/or other information) from a vehicle event review system the same as or similar to the vehicle event review systems described in U.S. patent application Ser. No. 14/592,245 filed Jan. 8, 2015 and entitled, "System And Method For Aggregation Display And Analysis Of Rail Vehicle Event Information" and U.S. patent application Ser. No.14/540,825 filed Nov. 13, 2014 and entitled, "System And Method For Detecting A Vehicle Event And Generating Review Criteria", both of which are incorporated by reference in their entirety.

Processor 30 of system 10 may be configured to provide information processing capabilities in system 10. As such, processor 30 may comprise one or more of a digital processor, an analog processor, a digital circuit designed to process information, an analog circuit designed to process information, a state machine, and/or other mechanisms for electronically processing information. Although processor 30 is shown in FIG. 1 as a single entity, this is for illustrative purposes only. In some implementations, processor 30 may comprise a plurality of processing units. These processing units may be physically located within the same device, or processor 30 may represent processing functionality of a plurality of devices operating in coordination (e.g., processor 18 of rail vehicle event recorder 20 operating in coordination with processor 30).

Processor 30 may be configured to execute one or more computer program components. The computer program components may comprise one or more of a communication component 32, an identification component 34, an information analysis component 36, and/or other components. Processor 30 may be configured to execute components 32, 34, and/or 36 by software; hardware; firmware; some combination of software, hardware, and/or firmware; and/or other mechanisms for configuring processing capabilities on processor 30. It should be appreciated that although components 32, 34, and 36 are illustrated in FIG. 1 as being co-located within a single processing unit, in implementations in which processor 30 comprises multiple processing units, one or more of components 32, 34, and/or 36 may be located remotely from the other components (e.g., within processor 18 (FIG. 2) of rail vehicle event recorder 20). The description of the functionality provided by the different components 32, 34, and/or 36 described herein is for illustrative purposes, and is not intended to be limiting, as any of components 32, 34, and/or 36 may provide more or less functionality than is described. For example, one or more of components 32, 34, and/or 36 may be eliminated, and some or all of its functionality may be provided by other components 32, 34, and/or 36. As another example, processor 30 may be configured to execute one or more additional components that may perform some or all of the functionality attributed below to one of components 32, 34, and/or 36.

Communication component 32 may be configured to obtain information that characterizes rail vehicle parameters during rail vehicle events and/or other information. Communication component 32 may be configured to obtain information from one or more vehicle event recorders 20 coupled with one or more rail vehicles 8, one or more review systems (e.g., included in external resources 70), and/or from other sources. The rail vehicle parameters may include geolocations of rail vehicles 8 during the rail vehicle events and/or other rail vehicle parameters. In some implementations, the obtained information that characterizes rail vehicle parameters during rail vehicle events may include times of day of the rail vehicle events, days of the week on which the rail vehicle events occur, and/or other information. In some implementations, communication component 32 may be configured to obtain information from external third party onboard systems (e.g., such as a ticketing system), third part off-board systems, and/or any other third party system generated information.

In some implementations, communication component 32 may be configured to obtain information that characterizes observations associated with the rail vehicle events made by rail vehicle event reviewers and/or other users (e.g., from a review system included in external resources 70). In some implementations, the rail vehicle events and/or the observations may be related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, activation of an ATP bypass and/or other rail vehicle events. In some implementations, the information that characterizes the geolocations of rail vehicles 8 during the rail vehicle events may be generated by one or more system location sensors that are coupled with the rail vehicles and/or one or more non-system location sensors that are not coupled with the rail vehicles (e.g., sensors 12 described below).

Identification component 34 may be configured to identify individual combinations of rail vehicle parameters associated with apparently elevated likelihoods of rail vehicle events. The individual identified combinations may include parameters that indicate shared geolocations where rail vehicle events have occurred, and/or other parameters. In some implementations, identification component 34 may be configured to normalize parameters in the identified individual combinations of rail vehicle parameters associated with apparently elevated likelihoods of rail vehicle events based on a frequency of rail vehicles passing through the shared geolocations where rail vehicle events have occurred, a severity of rail vehicle events at the shared geolocations, and/or other information.

In some implementations, identification component 34 may be configured to identify individual combinations of observations associated with apparently elevated likelihoods of rail vehicle events. The individual combinations of observations may include observations that indicate shared geolocations where rail vehicle events have occurred, and/or other information. In some implementations, identification component 34 may be configured to categorize the shared geolocations where rail vehicle events have occurred based on the time of day, the day of the week, and/or other factors.

Information analysis component 36 may be configured to analyze, disseminate, and/or perform other actions with the information related to the shared geolocations where vehicle events have occurred, and/or other parameters associated with apparently elevated likelihoods of rail vehicle events. In some implementations, this may include analyzing, based on the identification of individual combinations of rail vehicle parameters associated with apparently elevated likelihoods of rail vehicle events and/or other information, common features of the shared geolocations and predicting other geolocations in the rail network where rail vehicle events are likely to occur. For example, component 36 may determine that rail vehicle events frequently occur in an area heavily frequented by pedestrians (e.g., near a shopping mall). Component 36 may predict other locations near schools, sporting venues, etc. where rail vehicle events are likely based on the fact that these areas are also heavily frequented by pedestrians. Component 36 may make such determinations based information from identification component 34, information from external resources 70 (e.g., map information that describes locations of schools, sporting venues, etc.), information stored in electronic storage 60 (e.g., vehicle event information), and/or other information. With this information, users such as rail network administrators may implement specific operating procedures in these predicted event prone areas before events occur in these areas, for example.

Figure 3:
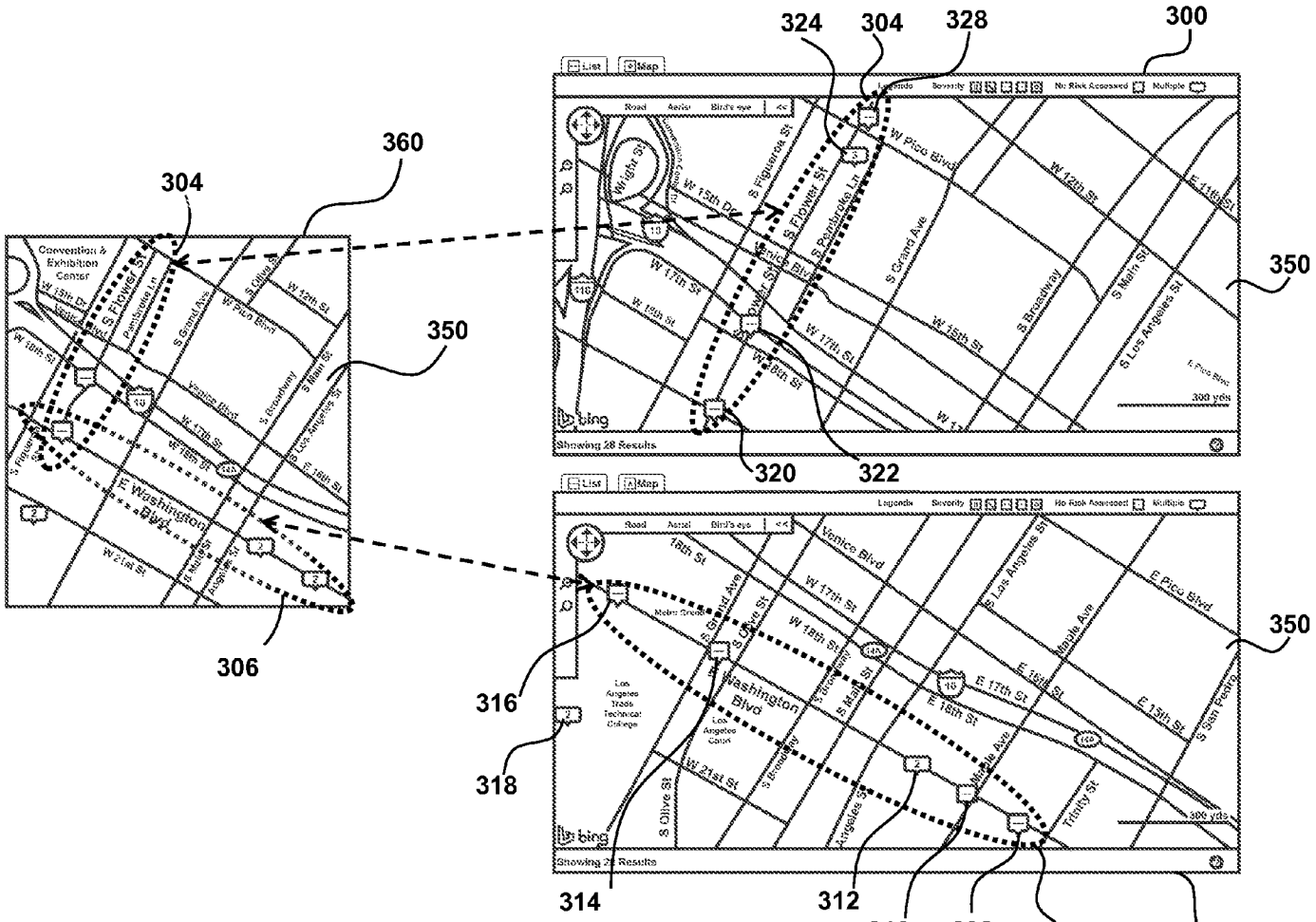
FIG. 3 illustrates views of a graphical user interface that identify two geolocations in a rail network where multiple rail vehicle events have occurred.

In some implementations, analyzing and/or disseminating the information may include indicating shared geolocations where rail vehicle events have occurred on a map of the rail network. For example, FIG. 3 illustrates view 300 and 302 of a graphical user interface (e.g., graphical user interface 52 described below) that identify two geolocations 304 and 306 in a rail vehicle network where multiple rail vehicle events 308, 310, 312, 314, 316, 318, 320, 322, 324, and 328 have occurred. Component 36 may be configured to overlay indications of these rail vehicle events on a map to illustrate areas within the rail network where rail vehicle events frequently occur (e.g., along Flower St. in view 300 and along Washington Blvd. in view 302). In some implementations, component 36 may be configured to overlay geolocations 304 and 306 on a common map 360 to illustrate that the rail vehicle events on Flower St. and Washington Blvd. may also be related in some way because of their proximity to each other. In some implementations, component 36 may be configured to indicate shared geolocations where rail vehicle events have occurred on a map in relation to the time of the day the rail vehicle events occur. For example, component 36 may be configured to indicate that speeding for all and/or a portion of rail vehicles or portion frequently occurs between 7.30 and 8.30 AM on a certain part of a route (a geolocation). This may be useful information when updating rail vehicle route scheduling and/or planning, for example. In some implementations, component 36 may be configured such that the time of the day and/or a type of incident together with the geolocation is identified.

In some implementations, analyzing and/or disseminating the information may include effectuating communication of instructions to operators of rail vehicles approaching the shared geolocations. For example, in FIG. 3, component 36 may effectuate communication of instructions to a rail vehicle operator in a rail vehicle that is approaching the intersection of Flower St. and Washington Blvd. The instructions may be and/or include an alert, instructions to slow down, instructions to watch for pedestrians and/or other vehicles, and/or other instructions. The instructions may be delivered to the rail vehicle operator via radio, a user interface included in a rail vehicle event detection system coupled with the rail vehicle, and/or via other methods.

In some implementations, analyzing and/or disseminating the information may include generating coaching information. The coaching information may be generated based on the shared geolocations where rail vehicle events have occurred and/or other information. The coaching information may be generated for presentation to a rail vehicle operator, a non-rail vehicle operator user, and/or other users during a coaching session. In some implementations, component 36 may generate coaching information responsive to entries and/or selections made via a user interface of system 10 (e.g., graphical user interface 52 shown in FIG. 1 and described below).

Figure 4:
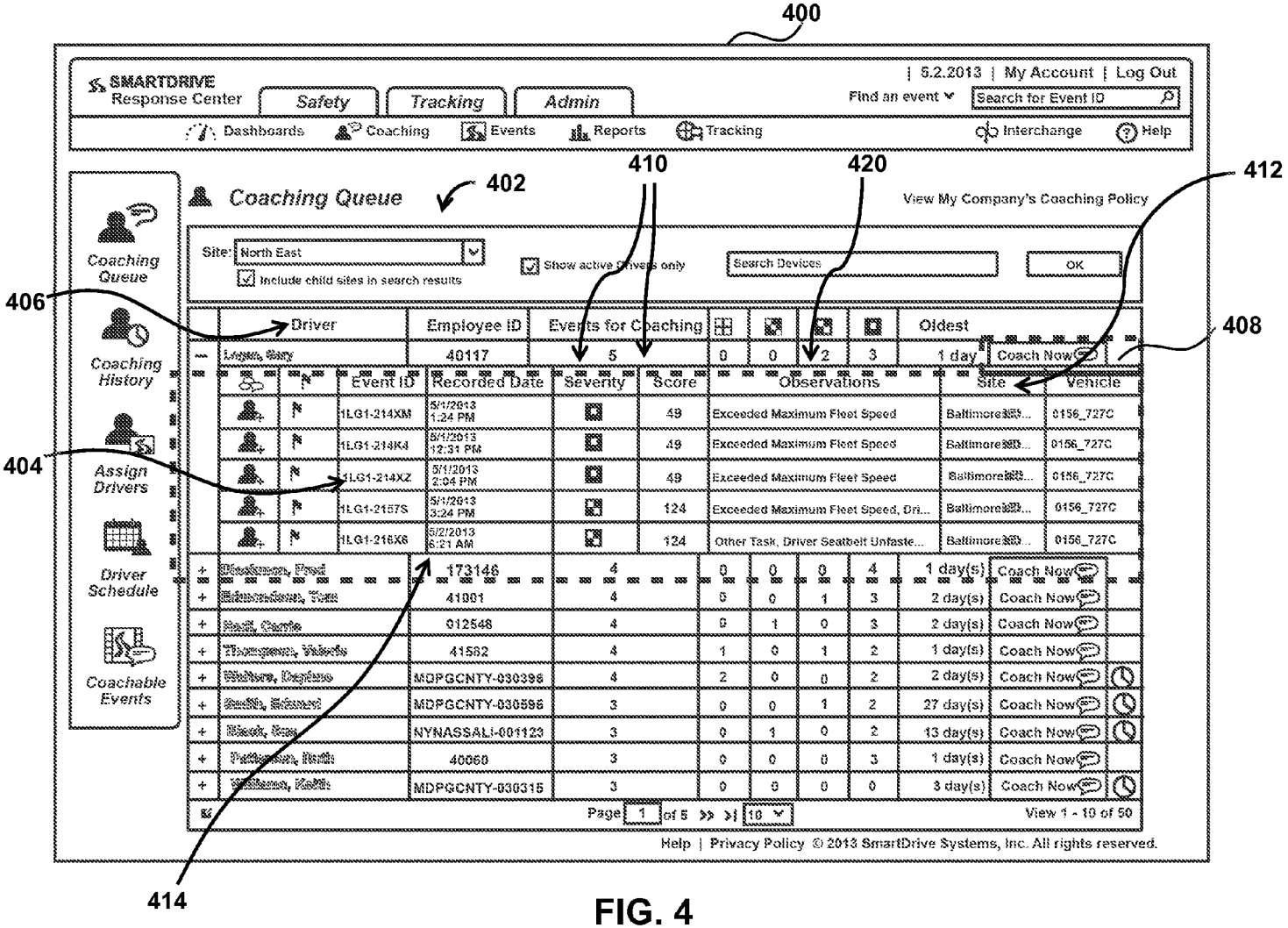
FIG. 4 illustrates a view of a coaching queue.

For example, FIG. 4 illustrates a view 400 of a coaching queue 402. As shown in FIG. 4, a user may be able to sort rail vehicle events 404 by driver/operator 406 of the rail vehicle. Once sorted, the user may be able to cause component 36 to generate coaching information for driver/operator 406 by selecting the "coach now" button 408. Responsive to the user selecting button 408, component 36 may analyze the information related to the shared geolocations where vehicle events have occurred for driver/operator 406, and/or other parameters associated with apparently elevated likelihoods of rail vehicle events in which driver/operator 406 was involved to determine appropriate coaching information. Component 36 may be configured to determine the coaching information based on the locations of the vehicle 412, a severity 410 of the vehicle events, the types of the vehicle events, the quantity of vehicle events, a date and/or time of the vehicle events 414, observations 420 related to the vehicle events, and/or other characteristics of the vehicle events in which driver/operator 406 was involved.

Returning to FIG. 1, computing system 50 may include one or more processors, a user interface, electronic storage, and/or other components. The user interface may include a display configured to display graphical user interface 52 and/or other components. Computing system 50 may be configured to enable a user (e.g., a reviewer and/or other users) to interface with system 10 (e.g., as described above), and/or provide other functionality attributed herein to computing system 50. Computing system 50 may be configured to communicate with processor 30, rail vehicles 8, rail vehicle event recorders 20, external resources 70, and/or other devices via a network such as the internet, cellular network, Wi-Fi network, Ethernet, and other interconnected computer networks. In some implementations, computing system 50 may be configured to communicate with processor 30, rail vehicles 8, rail vehicle event recorders 20, external resources 70, and/or other devices via wires. In some implementations, computing system 50 may include processor 30, and/or other components of system 10. Computing system 50 may facilitate viewing and/or analysis of the information determined by processor 30, the information stored by electronic storage 60, information provided by external resources 70, and/or other information. By way of non-limiting example, computing system 50 may include one or more of a server, a server cluster, desktop computer, a laptop computer, a handheld computer, a tablet computing platform, a NetBook, a Smartphone, a gaming console, and/or other computing platforms.

Graphical user interface 52 may comprise one or more views that include one or more fields configured to present information to and/or receive information from a user. In some implementations, an individual view of graphical user interface 52 may include one or more fields that correspond to one or more sensors of a vehicle event recorder 20, a timeline field, a field that includes a map of the rail system, and/or other fields. In some implementations, information presented in the one or more fields may be synchronized to a common timeline that is displayed in the timeline field, synchronized to a map of the rail system displayed in a map field, and/or other and or other features of graphical user interface 52. In some implementations, one or more fields of the graphical user interface may be configured to receive entry and/or selection of one or more observations made by a reviewer, may be configured to facilitate analysis of a set of rail vehicle events (e.g., mapping rail vehicle events onto a map of one or more portions of the rail network; sorting the rail vehicle events by date, day, time of day, rail vehicle operator, etc.). In some implementations, graphical user interface 52 may be configured to display coaching information and/or other information to users for a coaching session. In some implementations, graphical user interface 52 may be configured to display alerts to users of system 10. In some implementations, the graphical user interface may be configured to present information to a non-rail vehicle operator user (e.g., a reviewer) and/or other users in real-time or near real-time during operation of the rail vehicle.

Examples of graphical user interface 52 presenting information to and/or receiving information from a user include displaying an alert when an individual rail vehicle 8 is approaching a shared geolocation where vehicle events have occurred. Examples include displaying the locations of vehicle events on a map of the rail network. Examples include displaying sorted lists of geographic locations within the rail network, events by vehicle operator, common features of the shared geographic locations where vehicle events often occur, and/or other information.

Electronic storage 60 may be configured to store electronic information. Electronic storage 60 may comprise electronic storage media that electronically stores information. The electronic storage media of electronic storage 60 may comprise one or both of system storage that is provided integrally (i.e., substantially non-removable) with system 10 and/or removable storage that is removably connectable to system 10 via, for example, a port (e.g., a USB port, a firewire port, etc.) or a drive (e.g., a disk drive, etc.). Electronic storage 60 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 60 may store software algorithms, information determined by processor 30 (e.g., identified combinations of parameters, shared geolocations), information received via user interface 20, computing system 50 (e.g., observations), external resources 70 (e.g., previously determined rail vehicle event data), and/or other devices, and/or other information that enables system 10 to function properly. Electronic storage 60 may be (in whole or in part) a separate component within system 10, or electronic storage 60 may be provided (in whole or in part) integrally with one or more other components of system 10 (e.g., computing system 50, processor 30, etc.).

External resources 70 may include sources of information (e.g., an electronic vehicle event criteria database, a vehicle event records database, a vehicle event recorder, a vehicle event review system, one or more maps of a rail network and/or areas around the rail network, rail network schedules and or other rail network information, etc.), one or more servers that are part of system 10, one or more servers outside of system 10 (e.g., one or more servers associated with a rail vehicle client network), a network (e.g., the internet), electronic storage, equipment related to wireless communication technology, communication devices, and/or other resources. In some implementations, some or all of the functionality attributed herein to external resources 70 may be provided by resources included in system 10. External resources 70 may be configured to communicate with processor 30, computing system 50, and/or other components of system 10 via wired and/or wireless connections, via a network (e.g., a local area network and/or the internet), via cellular technology, via WiFi technology, and/or via other resources.

Figure 2:
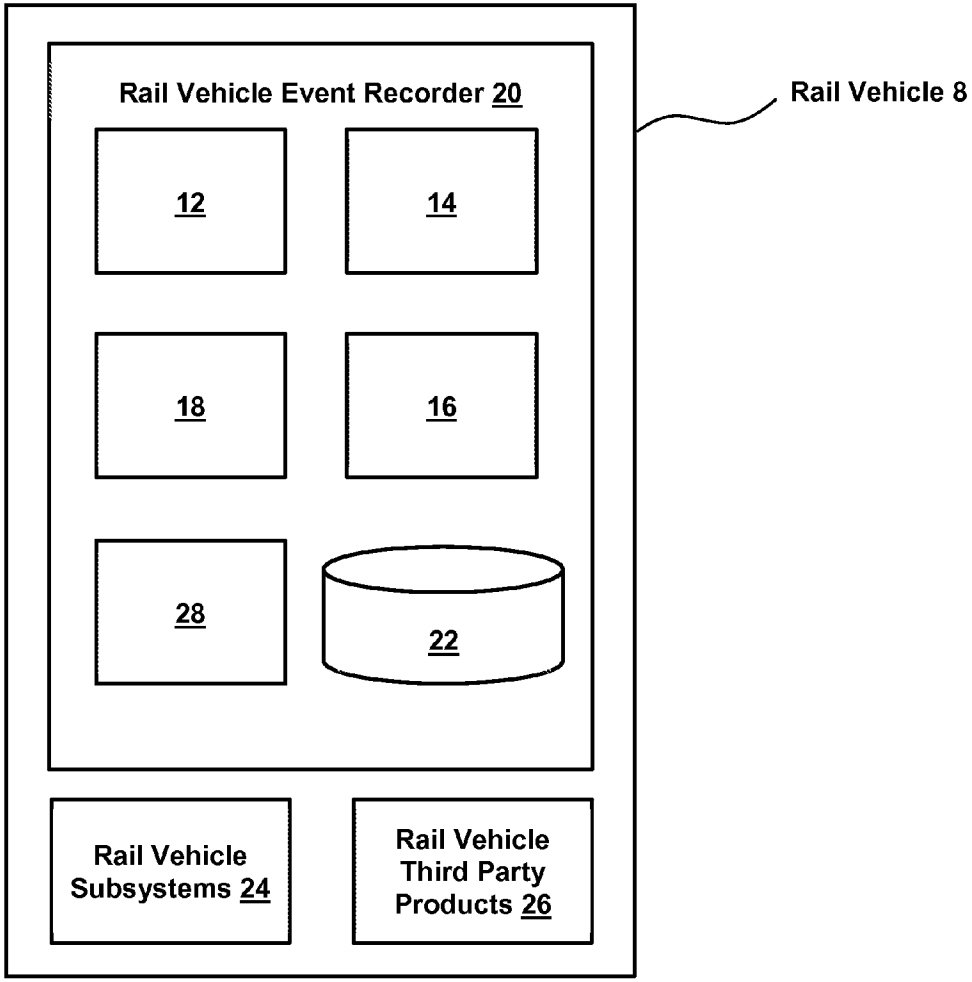
FIG. 2 illustrates an individual rail vehicle coupled with a rail vehicle event recorder.

FIG. 2 illustrates an individual rail vehicle 8 coupled with a rail vehicle event recorder 20. Rail vehicle event recorder 20 may include one or more of a sensor 12, a camera 14, a transceiver 16, a processor 18, a user interface 28, electronic storage 22, and/or other components.

In some implementations, rail vehicle event recorder 20 may be coupled to and/or otherwise in communication with rail vehicle subsystems 24, rail vehicle third party products 26, and/or other components of rail vehicle 8. Rail vehicle subsystems 24 may include mechanical subsystems, vehicle safety subsystems, track safety subsystems, inter-railcars safety subsystems, camera subsystems, DVR subsystems, and/or other rail vehicle subsystems. Rail vehicle event recorder 20 may be configured to be coupled with the rail vehicle subsystems so that information may be transmitted wirelessly and/or rail vehicle event recorder 20 may be physically coupled with the rail vehicle subsystems via wires and/or other physical couplings. Rail vehicle third party products 26 may include DVR systems, safety systems, and/or other rail vehicle third party products. In some implementations, rail vehicle event recorder 20 may be configured to communicate with rail vehicle third party products wireless and/or via wires. For example, rail vehicle event recorder 20 may be physically coupled with a rail third party DVR system. As another example, rail vehicle event recorder 20 may be configured to communicate with a CBTC safety system via a physical coupling.

Sensors 12 may be configured to generate output signals conveying information related to the operation and/or context of rail vehicle 8, and/or other information. In some implementations, the output signals may convey information related to safety systems of rail vehicle 8, mechanical systems of rail vehicle 8, communication systems of rail vehicle 8, passengers riding in rail vehicle 8, an operator of rail vehicle 8, movement of rail vehicle 8, an orientation of rail vehicle 8, a geographic position of rail vehicle 8, a track rail vehicle 8 rides on, a spatial position of rail vehicle 8 relative to other objects, and/or other information. Such output signals may be generated by one or more rail vehicle subsystem sensors (e.g., included in a vehicle on-board data system), one or more third party aftermarket sensors, and/or other sensors 12. Sensor 12 may include one or more sensors located adjacent to and/or in communication with the various mechanical systems of rail vehicle 8, adjacent to and/or in communication with the various safety systems of rail vehicle 8, in one or more positions (e.g., at or near the front/rear of rail vehicle 8) to accurately acquire information representing the vehicle environment (e.g. visual information, spatial information, orientation information), in one or more locations to monitor biological activity of the rail vehicle operator (e.g., worn by the rail vehicle operator), and/or in other locations. In some implementation, sensors 12 may include one or more of a video camera (e.g., one or more cameras 14), a rail vehicle safety system sensor, a rail vehicle mechanical system sensor, a rail vehicle electrical system sensor, an accelerometer, a gyroscope, a geolocation sensor, a radar detector, and/or other sensors.

Cameras 14 may be configured to acquire visual information representing a rail vehicle environment. Any number of individual cameras 14 may be positioned at various locations on and/or within rail vehicle 8. The rail vehicle environment may include spaces in and around an interior and/or an exterior of rail vehicle 8. Cameras 14 may be configured such that the visual information includes views of exterior sides of rail vehicle 8, interior compartments of rail vehicle 8, and/or other areas to capture visual images of activities that occur at or near the sides of rail vehicle 8, in front of and/or behind rail vehicle 8, within rail vehicle 8, on streets surrounding rail vehicle tracks, and/or in other areas. In some implementations, one or more cameras 14 may be rail vehicle system cameras previously installed in rail vehicle 8. In some implementations, one or more cameras 14 may be a third party aftermarket camera coupled with rail vehicle 8. In some implementations, visual information may be received from a third party camera and/or digital video recorder (DVR) system.

Transceiver 16 may comprise wireless communication components configured to transmit and receive electronic information. In some implementations, processor 30 may receive wireless communication of rail vehicle event information (e.g., output signals from sensors 12) via transceiver 16 and/or other wireless communication components. Transceiver 16 may be configured to transmit and/or receive encoded communication signals. Transceiver 16 may include a base station and/or other components. In some implementations, transceiver 16 may be configured to transmit and receive signals via one or more radio channels of a radio link; via one or more wireless networks such as a Wi-Fi network, the internet, a cellular network, and/or other wireless networks; and/or other communication networks. In some implementations, transceiver 16 may be configured to transmit and receive communication signals substantially simultaneously.

Processor 18 may be configured to provide information processing capabilities in rail vehicle event recorder 20. As such, processor 18 may comprise one or more of a digital processor, an analog processor, a digital circuit designed to process information, an analog circuit designed to process information, a state machine, and/or other mechanisms for electronically processing information. Although processor 18 is shown in FIG. 1 as a single entity, this is for illustrative purposes only. In some implementations, processor 18 may comprise a plurality of processing units. These processing units may be physically located within the same device, or processor 18 may represent processing functionality of a plurality of devices operating in coordination.

Electronic storage 22 may be configured to store electronic information. Electronic storage 22 may comprise electronic storage media that electronically stores information. The electronic storage media of electronic storage 22 may comprise one or both of system storage that is provided integrally (i.e., substantially non-removable) with rail vehicle event recorder 20 and/or removable storage that is removably connectable to rail vehicle event recorder 20 via, for example, a port (e.g., a USB port, a firewire port, etc.) or a drive (e.g., a disk drive, etc.). Electronic storage 22 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 22 may store software algorithms, recorded video event data, information determined by processor 18 (and/or processor 30), information received via user interface 28, and/or other information that enables rail vehicle event recorder 20 and/or system 10 to function properly. Electronic storage 22 may be (in whole or in part) a separate component within rail vehicle event recorder 20 and/or system 10, or electronic storage 22 may be provided (in whole or in part) integrally with one or more other components of rail vehicle event recorder 20 (e.g., user interface 28, processor 18, etc.).

User interface 28 may be configured to provide an interface between rail vehicle event recorder 20, and/or system 10 overall, and users, through which the users may provide information to and receive information from rail vehicle event recorder 20 and/or system 10. This enables predetermined profiles, criteria, data, cues, results, instructions, and/or any other communicable items, collectively referred to as "information," to be communicated between a user and one or more of processor 18, sensors 12, cameras 14, electronic storage 22, rail vehicle subsystems 24, rail vehicle third party products 26, and/or other components of rail vehicle event recorder 20 and/or system 10. In some implementations, all and/or part of user interface 28 may be included in a housing that houses one or more other components of rail vehicle event recorder 20, in computing system 50, and/or in other locations. Examples of interface devices suitable for inclusion in user interface 28 comprise a keypad, buttons, switches, a keyboard, knobs, levers, a display screen, a touch screen, speakers, a microphone, an indicator light, an audible alarm, a printer, a tactile feedback device, and/or other interface devices. In one implementation, user interface 28 comprises a plurality of separate interfaces (e.g., one interface in the driver compartment of rail vehicle 8 and one interface included in computing system 50). In some implementations, user interface 28 comprises at least one interface that is provided integrally with processor 18 and/or electronic storage 22. It is to be understood that other communication techniques, either hard-wired or wireless, are also contemplated by the present disclosure as user interface 28. In some implementations, user interface 28 may be included in a removable storage interface provided by electronic storage 22. In this example, information may be loaded into rail vehicle event recorder 20 wirelessly from a remote location (e.g., via a network), from removable storage (e.g., a smart card, a flash drive, a removable disk, etc.), and/or other sources that enable the user(s) to customize the implementation of rail vehicle event recorder 20. Other exemplary input devices and techniques adapted for use with rail vehicle event recorder 20 as user interface 28 comprise, but are not limited to, an RS-232 port, RF link, an IR link, modem (telephone, cable, and/or other modems), a cellular network, a Wi-Fi network, a local area network, and/or other devices and/or systems. In short, any technique for communicating information with rail vehicle event recorder 20 is contemplated by the present disclosure as user interface 28.

Figure 5:
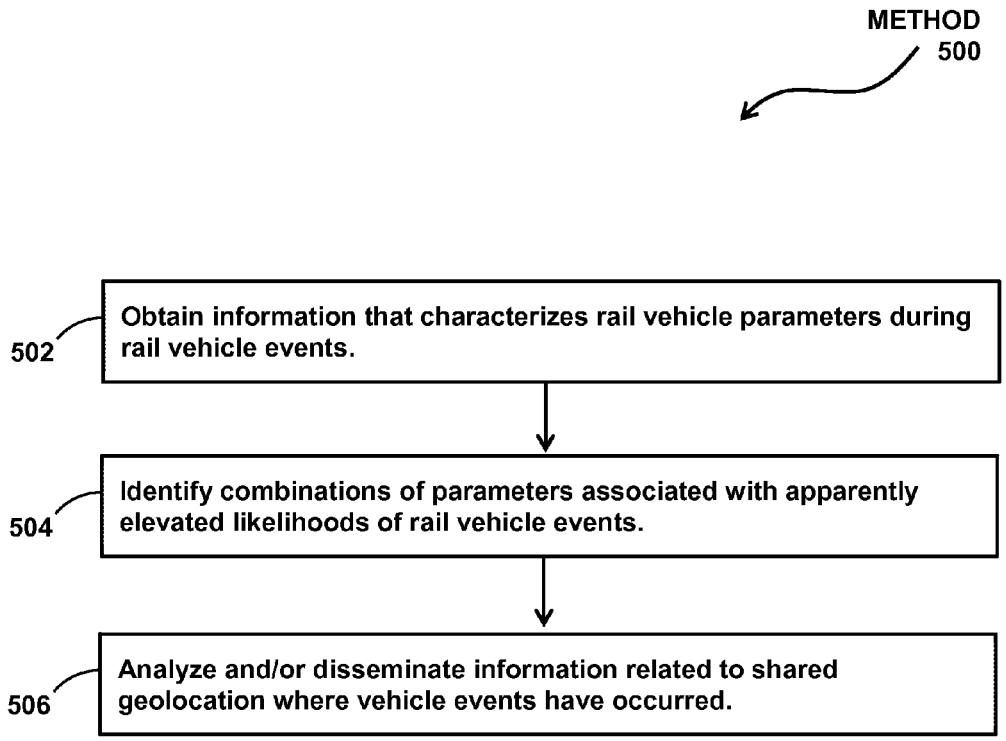
FIG. 5 illustrates a method for identifying geolocations in a rail network where rail vehicle events are likely to occur.

FIG. 5 illustrates a method 500 for identifying geolocations in a rail network where rail vehicle events are likely to occur. The operations of method 500 presented below are intended to be illustrative. In some implementations, method 500 may be accomplished with one or more additional operations not described, and/or without one or more of the operations discussed. Additionally, the order in which the operations of method 500 are illustrated in FIG. 5 and described below is not intended to be limiting. In some implementations, for example, two or more of the operations may occur substantially simultaneously.

In some implementations, method 500 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 500 in response to instructions stored electronically on one or more electronic storage mediums. The one or more processing devices may include one or more devices configured through hardware, firmware, and/or software to be specifically designed for execution of one or more of the operations of method 500.

At an operation 502, information that characterizes rail vehicle parameters during rail vehicle events may be obtained. The rail vehicle parameters may include geolocations of rail vehicles during the rail vehicle events. In some implementations, the obtained information that characterizes rail vehicle parameters during rail vehicle events may include times of day of the rail vehicle events, days of the week on which the rail vehicle events occur, and/or other information. In some implementations, operation 502 may include obtaining information that characterizes observations associated with the rail vehicle events made by rail vehicle event reviewers and/or other users. In some implementations, the rail vehicle events and/or the observations may be related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, or activation of an ATP bypass. In some implementations, the information that characterizes the geolocations of rail vehicles during the rail vehicle events may be generated by one or more system location sensors that are coupled with the rail vehicles and/or one or more non-system location sensors that are not coupled with the rail vehicles. In some implementations, operation 502 may be performed by a processor component the same as or similar to communication component 32 (shown in FIG. 1 and described herein).

At an operation 504, individual combinations of rail vehicle parameters associated with apparently elevated likelihoods of rail vehicle events may be identified. In some implementations, operation 504 may include normalizing parameters in the identified individual combinations of rail vehicle parameters associated with apparently elevated likelihoods of rail vehicle events based on one or more of a frequency of rail vehicles passing through the shared geolocations where rail vehicle events have occurred, a severity of rail vehicle events at the shared geolocations, and/or other information. The individual identified combinations may include parameters that indicate shared geolocations where rail vehicle events have occurred. In some implementations, operation 504 may include identifying individual combinations of observations associated with apparently elevated likelihoods of rail vehicle events. The individual combinations of observations may include observations that indicate shared geolocations where rail vehicle events have occurred, and/or other information. In some implementations, operation 504 may include categorizing the shared geolocations where rail vehicle events have occurred based on the time of day, the day of the week, and/or other factors. In some implementations, operation 504 may be performed by a processor component the same as or similar to identification component 34 (shown in FIG. 1 and described herein).

At an operation 506, information related to the shared geolocations where vehicle events have occurred may be analyzed and/or disseminated. In some implementations, this may include analyzing, based on the identification of individual combinations of rail vehicle parameters associated with apparently elevated likelihoods of rail vehicle events and/or other information, common features of the shared geolocations and predicting other geolocations in the rail network where rail vehicle events are likely to occur. In some implementations, this may include indicating shared geolocations where rail vehicle events have occurred on a map of the rail network. In some implementations, this may include effectuating communication of instructions to operators of rail vehicles approaching the shared geolocations. In some implementations, this may include generating coaching information based on the shared geolocations where rail vehicle events have occurred for presentation to one or more of a rail vehicle operator or a non-rail vehicle operator user during a coaching session. In some implementations, operation 506 may be performed by a processor component the same as or similar to information analysis component 36 (shown in FIG. 1 and described herein).

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A system configured to identify geolocations in a rail network where rail vehicle events are likely to occur based on prior rail vehicle events that occurred to rail vehicles, wherein the rail vehicles include a first rail vehicle and a second rail vehicle, wherein the first rail vehicle includes a first sensor and a first rail vehicle event recorder configured to detect rail vehicle events based on output signals generated by the first sensor, wherein the second rail vehicle includes a second sensor and a second rail vehicle event recorder configured to detect rail vehicle events based on output signals generated by the second sensor, the system comprising one or more physical computer processors configured by computer readable instructions to:

obtain information that characterizes rail vehicle parameters during prior rail vehicle events involving the rail vehicles, wherein the obtained information includes a first set of information regarding the rail vehicle events detected by the first rail vehicle event recorder and a second set of information regarding the rail vehicle events detected by the second rail vehicle event recorder, the rail vehicle parameters including geolocations of the rail vehicles during the prior rail vehicle events; and identify individual combinations of rail vehicle parameters associated with apparently elevated likelihoods of occurrences of rail vehicle events that are similar to the prior rail vehicle events, wherein the identified individual combinations include the rail vehicle parameters that indicate shared geolocations where the prior rail vehicle events have occurred, and wherein the identified individual combinations are based on the first and second sets of information.

2. The system of claim 1, wherein the one or more physical computer processors are further configured to effectuate communication of instructions to operators of rail vehicles approaching the shared geolocations.

3. The system of claim 1, wherein the one or more physical computer processors are further configured, based on the identification of the identified individual combinations, to analyze common features of the shared geolocations and further to predict other geolocations in the rail network where rail vehicle events are likely to occur based on the common features.

4. The system of claim 1, wherein the one or more physical computer processors are further configured to normalize the rail vehicle parameters in the identified individual combinations based on one or more of a frequency of rail vehicles passing through the shared geolocations where the prior rail vehicle events have occurred or a severity of the prior rail vehicle events at the shared geolocations.

5. The system of claim 1, wherein the one or more physical computer processors are further configured to indicate the shared geolocations where the prior rail vehicle events have occurred on a map of the rail network.

6. The system of claim 1, wherein the one or more physical computer processors are further configured to generate coaching information based on the shared geolocations where the prior rail vehicle events have occurred for presentation to one or more of a rail vehicle operator or a non-rail vehicle operator user during a coaching session.

7. The system of claim 1, wherein the one or more physical computer processors are further configured to:

obtain information that characterizes observations associated with the rail vehicle events made by rail vehicle event reviewers; and identify individual combinations of observations associated with apparently elevated likelihoods of rail vehicle events, wherein the individual combinations include observations that indicate the shared geolocations where rail vehicle events have occurred.

8. The system of claim 1, wherein the one or more physical computer processors are further configured such that:

the obtained information that characterizes rail vehicle parameters during rail vehicle events includes times of day of the rail vehicle events and days of the week the rail vehicle events occurred on; and the shared geolocations where rail vehicle events have occurred are categorized based on one or more of the time of day or the day of the week.

9. The system of claim 1, wherein the one or more processors are configured such that the prior rail vehicle events are related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, or activation of an ATP bypass.

10. The system of claim 1, wherein the one or more physical computer processors are configured such that the information that characterizes the geolocations of rail vehicles during the rail vehicle events is generated by one or more system location sensors that are coupled with the rail vehicles and/or one or more non-system location sensors that are not coupled with the rail vehicles.

11. A method for identifying geolocations in a rail network where rail vehicle events are likely to occur based on prior rail vehicle events that occurred to rail vehicles, wherein the rail vehicles include a first rail vehicle and a second rail vehicle, wherein the first rail vehicle includes a first sensor and a first rail vehicle event recorder configured to detect rail vehicle events based on output signals generated by the first sensor, wherein the second rail vehicle includes a second sensor and a second rail vehicle event recorder configured to detect rail vehicle events based on output signals generated by the second sensor, the method comprising:

obtaining information that characterizes rail vehicle parameters during prior rail vehicle events involving the rail vehicles, wherein the obtained information includes a first set of information regarding the rail vehicle events detected by the first rail vehicle event recorder and a second set of information regarding the rail vehicle events detected by the second rail vehicle event recorder, the rail vehicle parameters including geolocations of the rail vehicles during the prior rail vehicle events; and identifying individual combinations of rail vehicle parameters associated with apparently elevated likelihoods of occurrences of rail vehicle events that are similar to the prior rail vehicle events, wherein the identified individual combinations include the rail vehicle parameters that indicate shared geolocations where the prior rail vehicle events have occurred, and wherein the identified individual combinations are based on the first and second sets of information.

12. The method of claim 11, further comprising effectuating communication of instructions to operators of rail vehicles approaching the shared geolocations.

13. The method of claim 11, further comprising analyzing, based on the identification of the identified individual combinations, common features of the shared geolocations; and predicting other geolocations in the rail network where rail vehicle events are likely to occur based on the common features.

14. The method of claim 11, further comprising normalizing the rail vehicle parameters in the identified individual combinations based on one or more of a frequency of rail vehicles passing through the shared geolocations where the prior rail vehicle events have occurred or a severity of the prior rail vehicle events at the shared geolocations.

15. The method of claim 11, further comprising indicating the shared geolocations where the prior rail vehicle events have occurred on a map of the rail network.

16. The method of claim 11, further comprising generating coaching information based on the shared geolocations where the prior rail vehicle events have occurred for presentation to one or more of a rail vehicle operator or a non-rail vehicle operator user during a coaching session.

17. The method of claim 11, further comprising:

obtaining information that characterizes observations associated with the rail vehicle events made by rail vehicle event reviewers; and identifying individual combinations of observations associated with apparently elevated likelihoods of rail vehicle events, wherein the individual combinations include observations that indicate the shared geolocations where rail vehicle events have occurred.

18. The method of claim 11, wherein:

the obtained information that characterizes rail vehicle parameters during rail vehicle events includes times of day of the rail vehicle events and days of the week the rail vehicle events occurred on; and the shared geolocations where rail vehicle events have occurred are categorized based on one or more of the time of day or the day of the week.

19. The method of claim 11, wherein the prior rail vehicle events are related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, or activation of an ATP bypass.

20. A system configured to identify geolocations in a rail network where rail vehicle events are likely to occur based on prior rail vehicle events that occurred to rail vehicles, wherein the rail vehicles include a first rail vehicle and a second rail vehicle, the system comprising:

a first rail vehicle event recorder configured to detect first rail vehicle events based on output signals generated by a first accelerometer carried by the first rail vehicle;

a second rail vehicle event recorder configured to detect second rail vehicle events based on output signals generated by a second accelerometer carried by the second rail vehicle;

a third rail vehicle event recorder configured to detect third rail vehicle events based on output signals generated by a third accelerometer carried by the third rail vehicle;

one or more physical computer processors configured by computer readable instructions to:

receive information from the first rail vehicle that characterizes first rail vehicle parameters, wherein the first rail vehicle parameters are based on the detected first rail vehicle events, and wherein the received information from the first rail vehicle includes geographic locations and time-of-day of the detected first rail vehicle events;

receive information from the second rail vehicle that characterizes second rail vehicle parameters, wherein the second rail vehicle parameters are based on the detected second rail vehicle events, and wherein the received information from the second rail vehicle includes geographic locations and time-of-day of the detected second rail vehicle events;

receive information from the third rail vehicle that characterizes third rail vehicle parameters, wherein the third rail vehicle parameters are based on the detected third rail vehicle events, and wherein the received information from the third rail vehicle includes geographic locations and time-of-day of the detected third rail vehicle events;

identify individual combinations of first, second, and third rail vehicle parameters associated with apparently elevated likelihoods of occurrences of rail vehicle events that are similar to previously detected rail vehicle events, wherein the identified individual combinations include the geographic locations of the previously detected rail vehicle events; and effectuate communication of instructions to operators of rail vehicles approaching the geographic locations of the previously detected rail vehicle events.

* * * * *